US005726662A

United States Patent [19]

Hopwood

[11] Patent Number: 5,726,662

[45] Date of Patent: Mar. 10, 1998

[54] FREQUENCY COMPENSATED MULTI-BEAM ANTENNA AND METHOD THEREFOR

[75] Inventor: Francis W. Hopwood, Severna Park, Md.

[73] Assignee: Northrop Grumman Corporation, Los Angeles, Calif.

[21] Appl. No.: 565,610

[22] Filed: Nov. 29, 1995

[51] Int. Cl.[6] ..... H01Q 3/22; H01Q 3/24; H01Q 3/26

[52] U.S. Cl. ..... 342/372; 342/373

[58] Field of Search ..... 342/372, 373

[56] References Cited

U.S. PATENT DOCUMENTS 4,595,926 6/1986 Kobus et al. ..... 342/368

4,980,691 12/1990 Rigg et al. ..... 342/372

5,134,417 7/1992 Thompson ..... 342/375

5,510,796 4/1996 Applebaum ..... 342/162

*Primary Examiner*—Theodore M. Blum

*Attorney, Agent, or Firm*—Walter G. Sutcliff

[57] ABSTRACT

A frequency compensator allows the frequency of a multiple element array to be varied while maintaining a constant separation of the multiple beams output from the array. Since the apparent position of the elements is a function of frequency, by changing the apparent distance in accordance with frequency such that the elements appear to be at desired position, the beamsets may remain relatively aligned as the frequency changes. Both transmitted and received beamsets may be compensated.

8 Claims, 6 Drawing Sheets

FIG.3
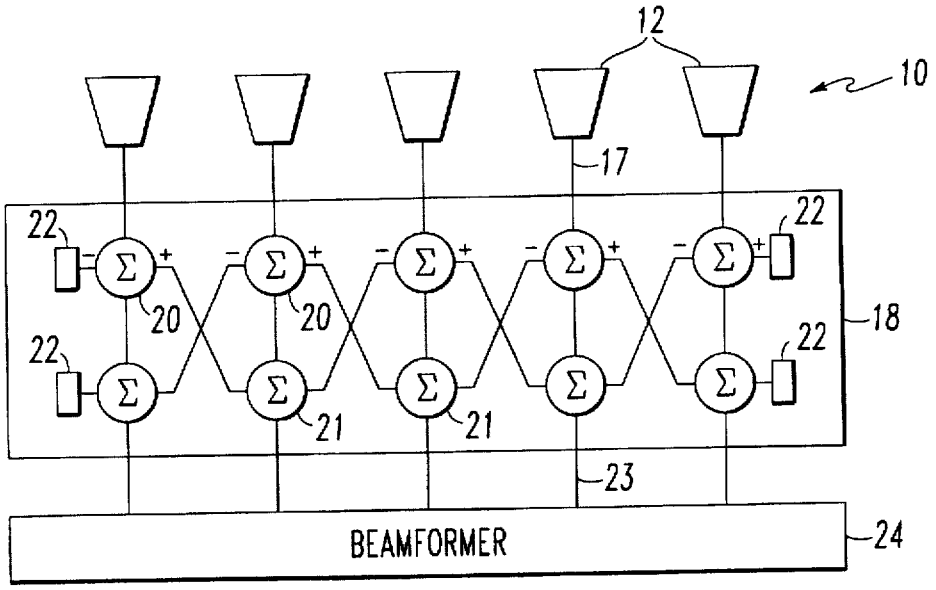
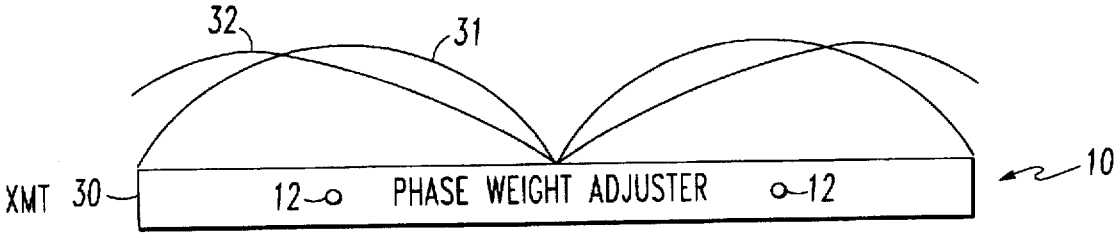
FIG.5

FIG.4A
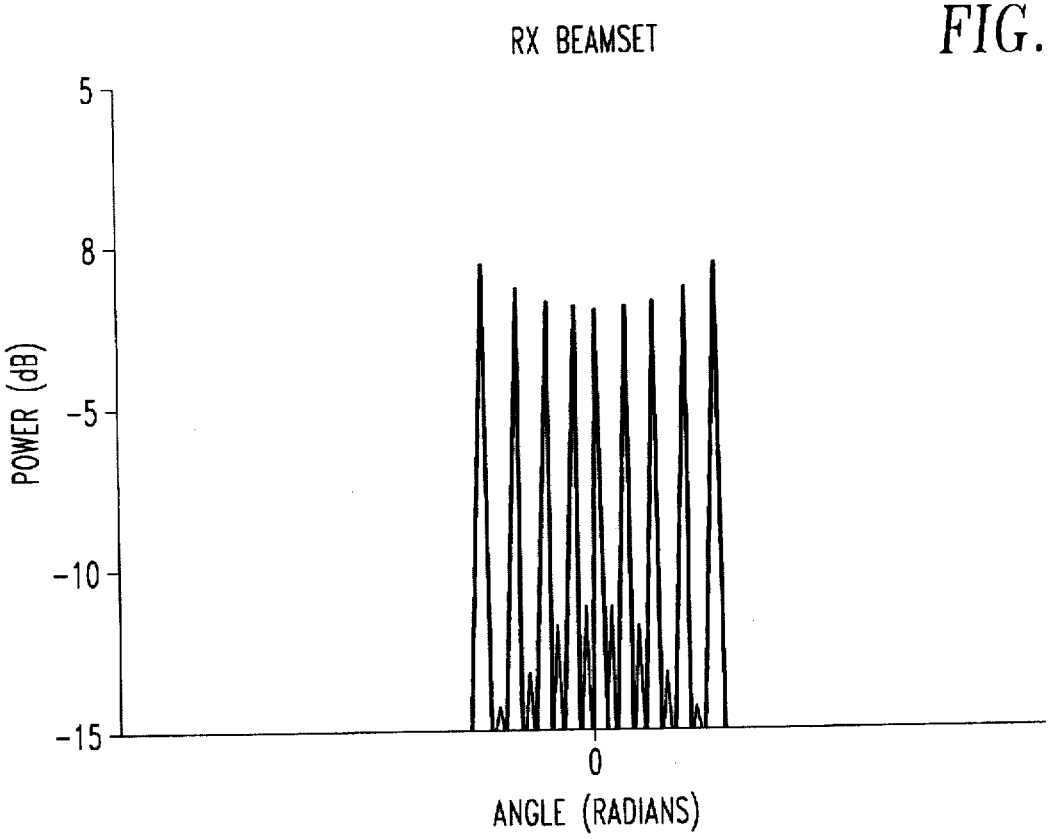
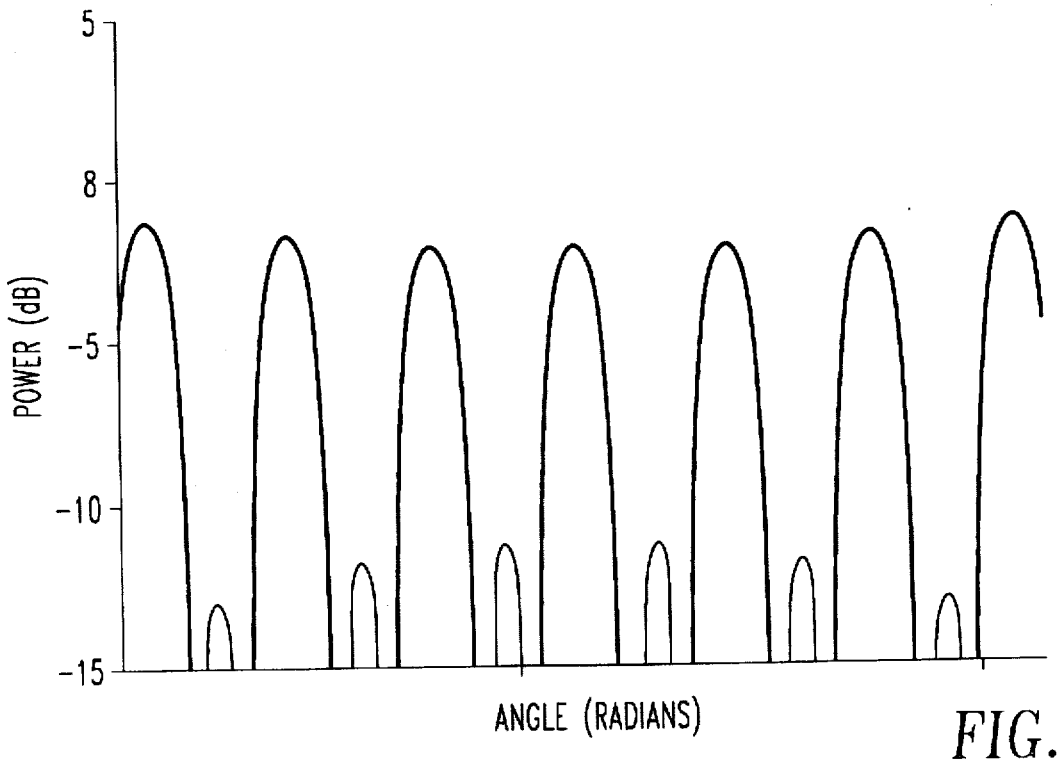
FIG.4B

FIG.4C
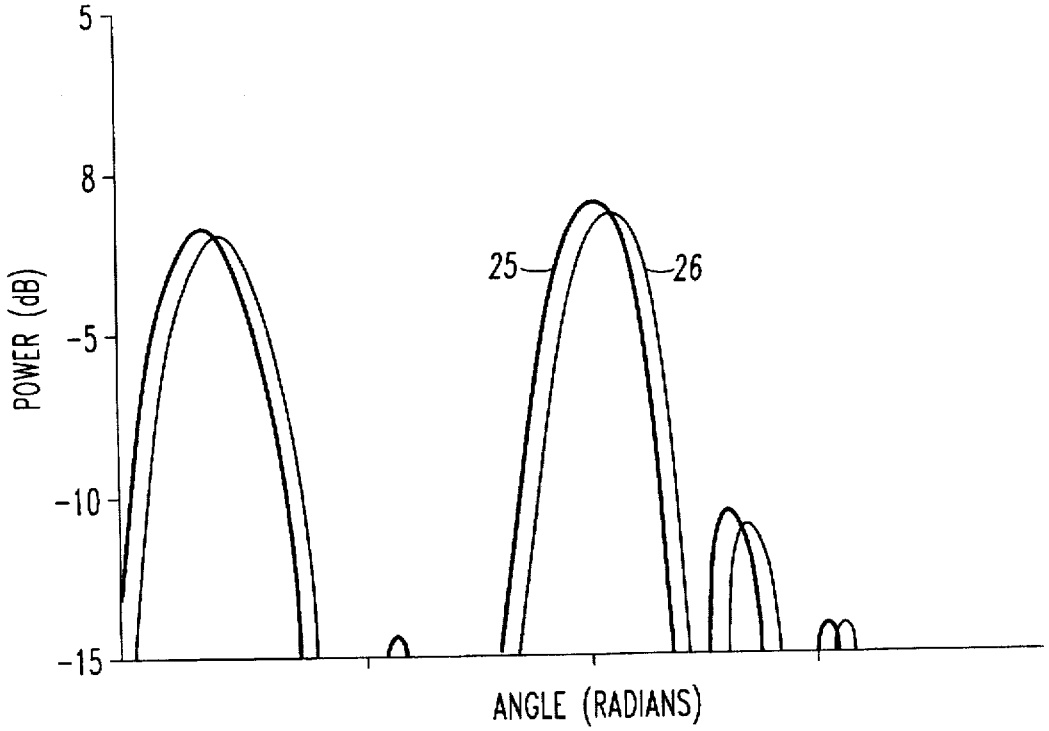
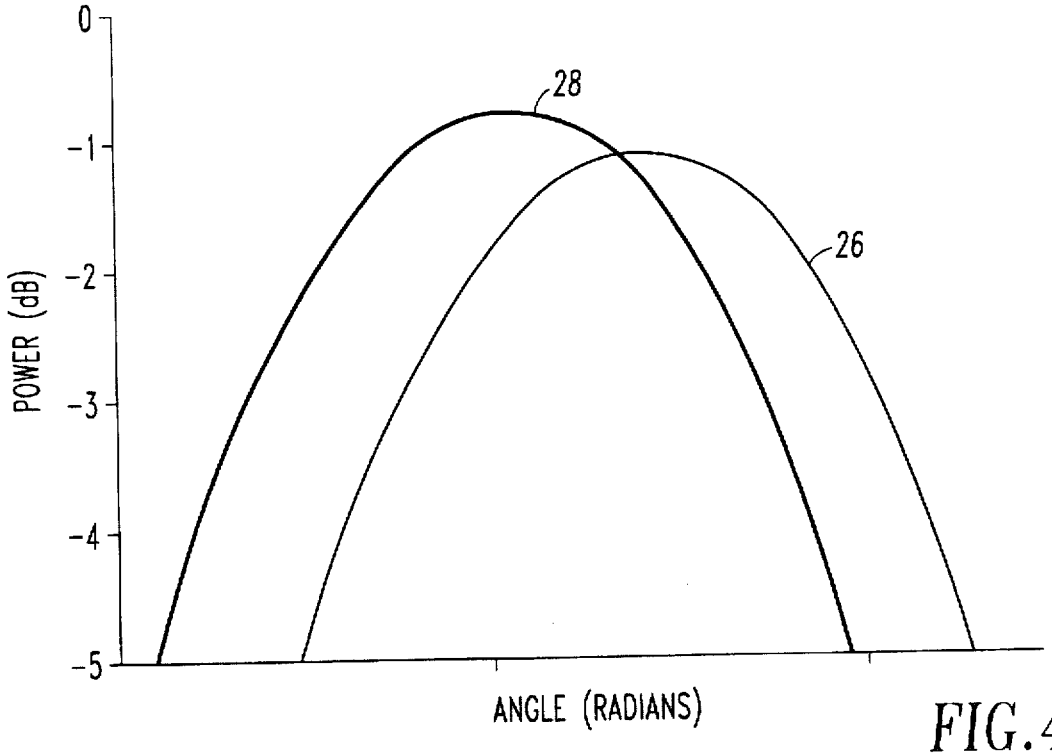
FIG.4D

FIG.6A
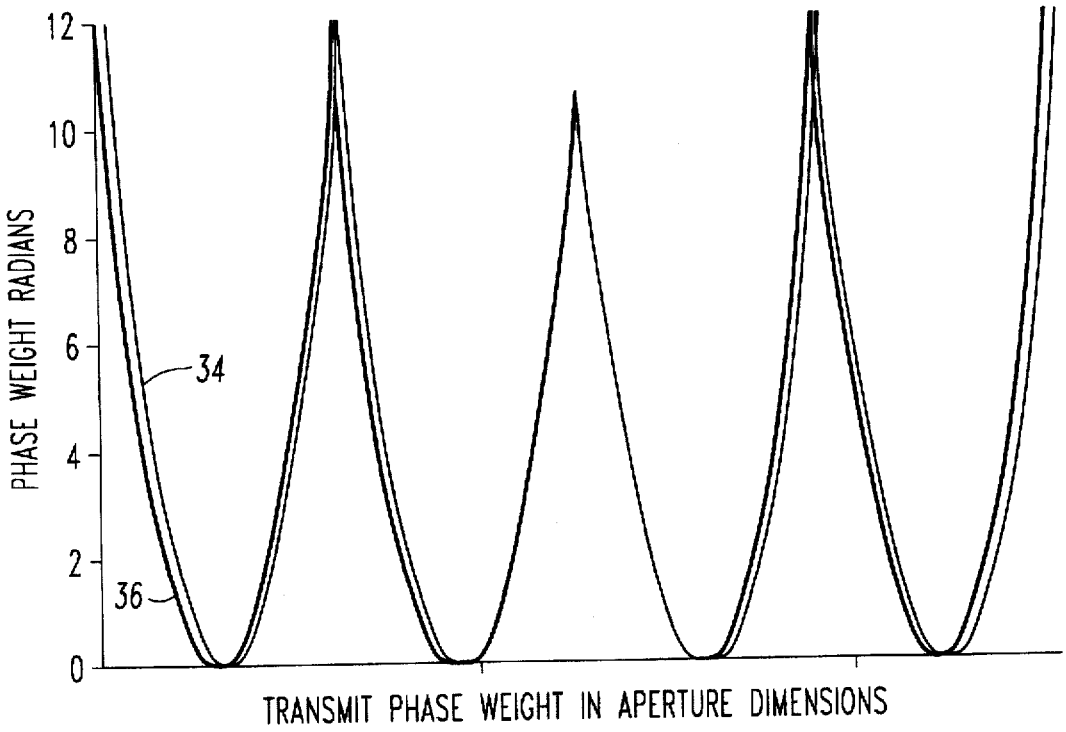
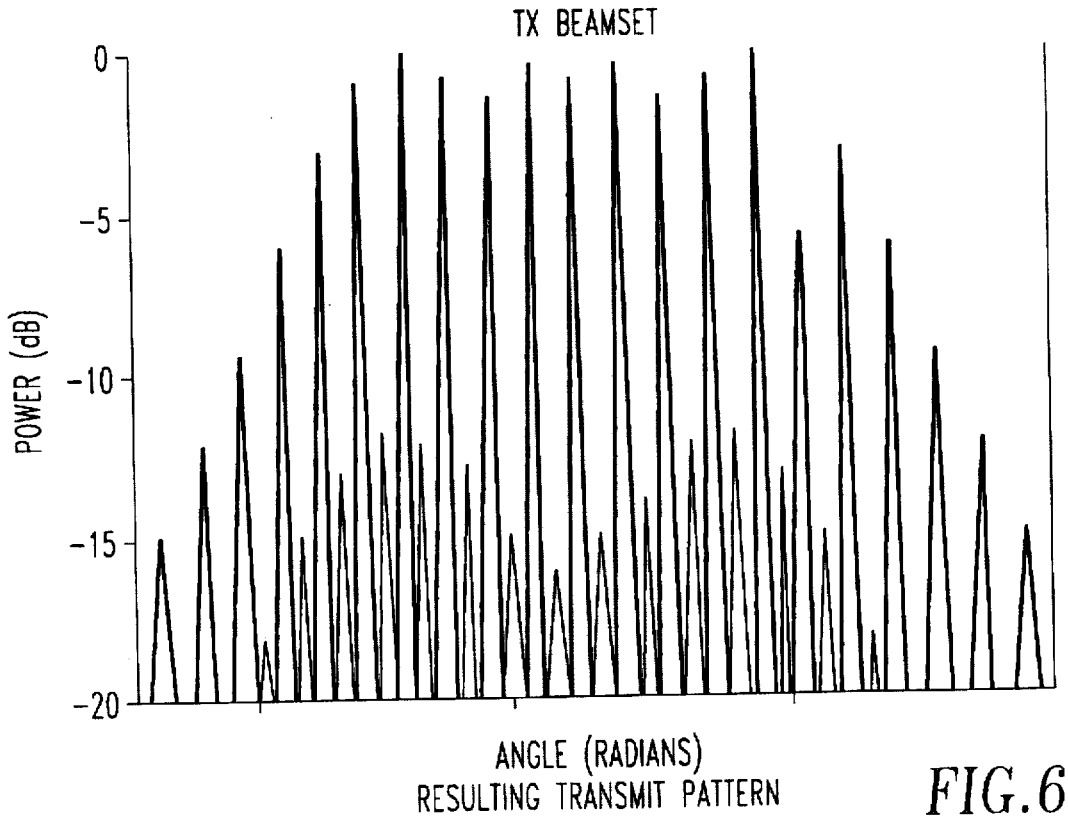
FIG.6B

FREQUENCY COMPENSATED MULTI-BEAM ANTENNA AND METHOD THEREFOR

BACKGROUND OF THE INVENTION

1. Field of the Invention

The present invention is directed to a multi-beam antenna, in particular, a multi-beam antenna in which all of the beams are stable with frequency, a frequency compensator therefor and a method for frequency compensation.

2. Description of Related Art

Most radar emit one beam in a certain direction and then sequentially emit another beam such that the beams emitted are separated in time. Certain classes of radar use multiple simultaneous transmit and receive beams to enhance their search rate capability. If the radar can support N beams with adequate transmit power in gain, and sufficient receivers and processing channels, performance is similar to that of N simultaneous radar acting in synchronism and the search rate increases by N. If N is large, and sufficient power and processing resources are expended, the performance enhancement can be substantial.

The simultaneous transmit beams are commonly generated in either of two ways. First, if a sequential pulse burst (SPB) is used, the transmit pulse is composed of N sub-pulses originating from a common aperture, each of which is transmitted to its own angle and space. The transmit signal is sequential, but the received waveforms are generally simultaneous from the various angles. Second, if transmit interferometry (TI) is used, the transmit aperture is broken into sub-apertures which are spatially combined to form multiple, simultaneous transmit beams.

Performance of the SPB and the TI are similar in most respects. SPB suffers a loss of data due to transmit switching time between sub-pulses. TI suffers a loss due to power variation from beam to beam, and to power lost to undesired beams. Both techniques are commonly practiced.

In an ordinary single beam radar, when the frequency is changed, time delay compensation is used to ensure that the beam propagates back to a central point. When a set of beams is used, as in TI, the typical time delay compensation only works for the center beam. The remaining off-center beams scan with frequency. This is due to the fact that the apparent spacing between the sub-apertures changes with frequency, as in any interferometer.

There are numerous reasons for wanting to change the frequency during operation of the antenna. For example, when using a long pulse with a lot of energy and a close target, the return energies mix, i.e., jamming results. Additionally, when observing an object, different features may be examined by utilizing different frequencies.

SUMMARY OF THE INVENTION

It is an object of the present invention to provide a means and method of eliminating the beam misalignment with frequency in a radar array during both transmission and reception. It is a further object of the present invention to provide a practical solution to the above-noted problem.

A frequency compensator for an array having multiple elements includes an input which receives data from the array, and an interpolator which positions each of the multiple elements of the array at a desired apparent location. The interpolator maintains beam spacing of a beamset at a constant value as an operational frequency of the array is varied. The frequency compensator may be used when the array is a receiver or a transmitter.

When the frequency compensator is used with a receiver antenna, the interpolator generates the desired apparent location in accordance with a signal output from the multiple element being positioned and multiple elements adjacent thereto. The interpolator may include couplers and variable attenuators for adding signals from adjacent elements to a signal from an element of interest.

When the frequency compensator is used with a transmitter antenna, the interpolator changes a phase weighting applied to each of the transmitters.

A frequency compensated multi-beam array includes a plurality of elements separated by a sub-array spacing, means for operating the array at a nominal frequency, means for varying a frequency at which the array is operated from the nominal frequency, and means for generating beamsets output by the plurality of elements from varied frequencies that are aligned with a beamset output by the array at the nominal frequency. The means for generating beamsets may include an interpolator which positions an apparent location of each of the elements at a desired location. The plurality of elements in the frequency compensated multi-beam array may be receivers or transmitters.

When the elements are receivers the means for generating beamsets may include couplers and variable attenuators for adding signals from adjacent elements to a signal from an element of interest. When the elements are transmitters, the means for generating beamsets may include means for changing a phase weighting applied to each of the transmitters.

A method for compensating for a change in frequency in an array having multiple elements includes the steps of varying an operation frequency of the array and adjusting an apparent position of the multiple elements to a desired position in accordance with the operation frequency. The adjusting step maintains a spacing of a beamset output from the multiple elements at a constant level. The adjusting step may include receiving a signal from each of the multiple elements and interpolating a desired position of each of the multiple elements in accordance with a signal output from an element and signals output from elements adjacent thereto. The adjusting step may include receiving the operation frequency to be transmitted and altering a phase weighting of the elements in accordance with the operation frequency.

These and other objects of the present invention will become more readily apparent from detailed description given hereinafter. However, it should be understood that the detailed description and specific examples, while indicating the preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limited to the present invention and wherein:

FIG. 3 illustrates an embodiment of an antenna array including a received beam frequency compensator of the present invention;

FIGS. 4A–4D show the receiver beamset both with and without the frequency compensation of the present invention in increasing detail;

FIG. 5 illustrates the desired positioning of the transmit beam;

FIG. 6A shows a weighting function for the transmit beams with and without frequency compensation of the present invention;

FIG. 6B shows the transmission beamset with and without frequency compensation of the present invention.

DETAILED DESCRIPTION OF THE PREFERRED EMBODIMENTS

Misalignment between beamsets at different frequencies is caused by the fact that the beam spacing Da between sub-apertures is equal to:

$$Da=c/(F\times D) \quad (1)$$

where F is frequency, D is the sub-array spacing and c is the speed of light.

Figure 1A:
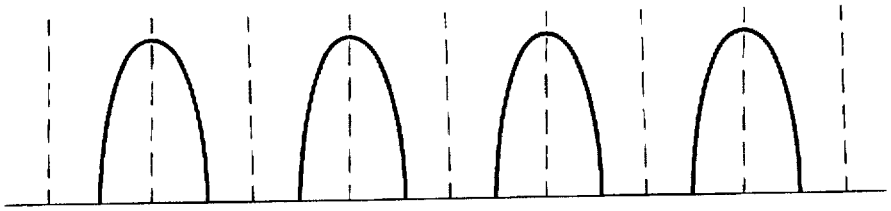
FIG. 1A illustrates a beamset at a first frequency F1.
Figure 1B:
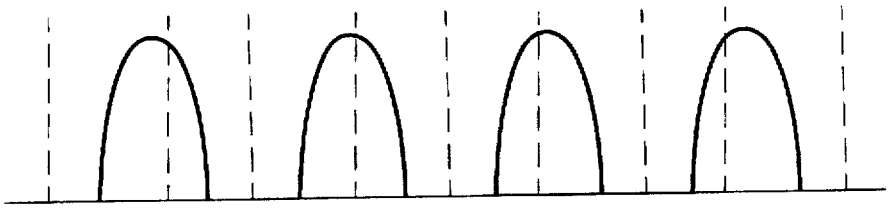
FIG. 1B illustrates a beamset at a second frequency F2.

This misalignment can clearly be seen in FIGS. 1A and 1B. FIG. 1A shows a beamset from an antenna operating at a first frequency F1. FIG. 1B shows a beamset from the same antenna operating at a second frequency F2, which, in this example, is smaller than the first frequency F1. As can be seen, these beamsets are not aligned with one another. Since the second frequency F2 is smaller than the first frequency F1, the beam spacing in FIG. 1B is further apart than that in FIG. 1A, as would be expected from Equation (1). In particular, as beams are further from the center, they become more misaligned.

Figure 2A:
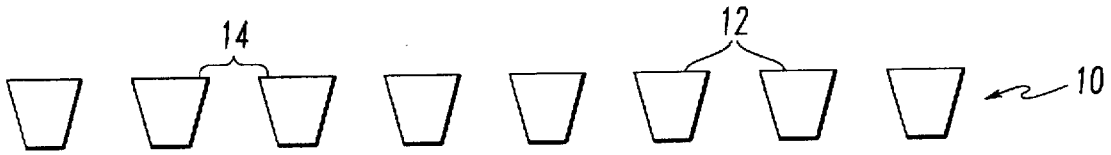
FIG. 2A illustrates a desired sub-array location for the antenna operated at frequency F1.
Figure 2B:
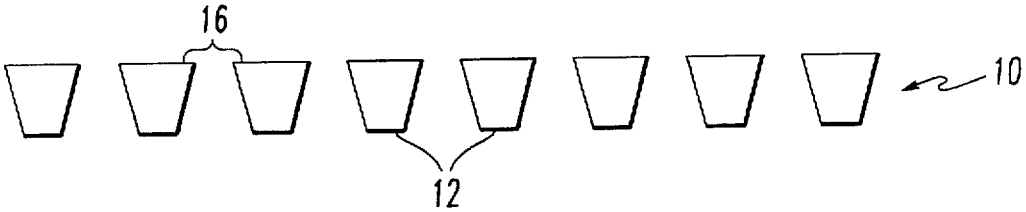
FIG. 2B illustrates a desired sub-array location for the antenna operated at frequency F2.

As shown in FIGS. 2A and 2B, a desired location in an array 10 for sub-arrays 12 includes a desired sub-array spacing 14 when the array 10 is operated at a frequency F1. As can be seen in FIG. 2B, a desired sub-array spacing 16 when the array 10 is operated at a frequency F2 differs from the desired sub-array spacing 14 when the array 10 is operated at the frequency F2. In particular, as can be determined from the relationship noted above, when the operational frequency of the array 10 is decreased from F1 to F2, the desired sub-array spacing decreases from sub-array spacing 14 to sub-array spacing 16, thereby compensating for the fact that beams in a beamset at F2 will be spaced further apart than beams in a beamset at F1 if both beamsets are generated from the same array.

An overall goal of the present invention is to hold sub-array spacing Da, i.e., the apparent product of the frequency F and the sub-array spacing D, constant as the frequency F is changed. Since the operational frequencies of the array 10 are selected, the apparent sub-array spacing D must be varied. In principle, the array 10 could be re-partitioned using a switch matrix, i.e., the sub-arrays 12 could be rearranged physically in order to actually be placed at the respective desired sub-array spacings 14, 16 at the respective operational frequencies F1, F2. However, a typical multi-beam antenna will have thousands of elements, such that re-partitioning the array 10 with a switch matrix would be extremely complicated to the point of being impractical. Therefore, a preferred embodiment of the present invention, as discussed in detail below, provides a different way of frequency compensating the beamsets.

FIG. 3 shows a beamset receiver including the array 10 of sub-arrays 12, a frequency compensation network 18 and a beamformer 24. The beamformer 24 may be any of the commonly practiced beamformers, such as a Butler matrix or a Fast Fourier Transform (FFT) beamformer. The sub-arrays or elements 12 can be either active or passive. Time delay compensation is part of the sub-array if the application specific instantaneous bandwidth requires it.

Interpolation algorithms as commonly practiced are used in digital signal processing and are commonly used to construct a new data set from an existing data set which has been sampled in undesired points. The newly constructed data set is sampled at the desired points. If the sub-arrays 12 are considered to be samplers of angle space, the samples can be considered to have been taken at undesired points in space as the operation frequency of the antenna is changed from the nominal frequency at which the sub-arrays 12 are positioned in the desired configuration, i.e., the physical sub-array spacing equals the desired sub-array spacing D. The desired samples and angle space can be constructed from the undesired samples by interpolation using the frequency compensation network 18.

There are numerous interpolation algorithms. Some form of a weighted, truncated, sin(x)/x interpolator is often used in signal processing. However, this algorithm is too complicated for the present application as it would require a complex circuit. A simple linear interpolator is easily realizable and provides adequate performance. One rendition of such a simple linear interpolator is as follows. If the data from sub-array (J) is S(J), the compensated data is S(j+e) which represents data from an incrementally different point in space. The variable (e) is the desired fraction of a sub-array spacing that a sub-array (J) is moved by. It can be approximated by using data from three adjacent sub-arrays by the following equation:

$$S(J+e)=S(J)+e/2*(S(J+1)-S(J-1)) \quad (2)$$

This simple three point linear interpolator may be used to modify the data from the sub-array (J) to make it appear to have moved to a new position. The apparent position of a sub-array 12 can be changed by adding a scaled sample of the signal from the sub-array on either side of it to its own signal.

A specific embodiment of such an interpolator is shown as the frequency compensation network 18 in FIG. 3. The frequency compensation network 18 receives signals output from the sub-arrays 12 along input lines 17. The frequency compensation network is a matrix of controllable attenuators 20 and couplers 21 that couple into each sub-array output path 23 properly scaled signals from adjacent sub-arrays. The coupling variable is adjusted in accordance with Equations (1) and (2) to compensate for the known frequency by changing the controllable attenuators 20. The controllable attenuators 20 are programmable in response to the system needs. The couplers 21 add the outputs of controllable attenuators 20 corresponding to adjacent sub-arrays 12 (J+1, J−1) (which have been attenuated by a factor of e/2 by the controllable attenuators 20) to the signal from the sub-array 12 (J) corresponding to the coupler 21. The sub-arrays on either end obtain compensation from only one side, so the interpolation calculation of Equation (2) is modified accordingly from the terminations 22, e.g., replacing S(J+1) with S(J) or some other suitable value for the sub-array at the far right.

The thus modified sub-array signal thereby appears to have originated from a sub-array in a slightly different location in the antenna mechanization for frequency compensating the receive beams so that they appear in angle space at the desired location even though their frequency has been changed. The modified sub-array signals are output from the frequency compensation network 18 via output lines 23 to the beamformer 24.

Alternatively, the frequency compensation could be performed digitally if analog to digital conversion was performed after the sub-arrays. The beamformer 24 could be mechanized as an ordinary Fast Fourier Transform.

FIGS. 4A–4D show a beamset as a function of angle versus relative power with and without the frequency compensation of the present invention, with the multi-beam antenna array operating in the microwave region. FIGS. 4A–4D are shown with increasing detail. The beamset without compensation is indicated by the curve 26, while the beamset with frequency compensation of the present invention is indicated by the curve 28.

The more detailed views of the beamsets shown in FIGS. 4C and 4D are a portion of the beamset to the right of the center beam in FIG. 4A. The center beam of the beamset remains stationary while the outer beams move toward the center when frequency compensation is applied, thereby demonstrating the desired effect.

The frequency compensation of the present invention for the transmit array is simpler than that for the receive array. As discussed in the Background section, TI is practiced by splitting a transmit antenna into a number of physically separated phase centers. When the signals from the phase centers are combined in space, a cluster of simultaneous beams are formed, each propagating towards a different angle. As discussed above, the beams are equally spaced by c/(F×D) in sine space, where D is the distance between the centers of the transmit sub-arrays, F is the operating frequency of the array, and c is the speed of light. In distributing TI, transmit power radiates from all parts of the antenna, and a phase weighting, which is nearly quadratic, is used to focus transmit energy so that the far field signals resembles that of a discrete interferometer.

By modifying the phase weights using a phase weight adjuster 30, apparent phase centers can be moved on the antenna 10, as shown in FIG. 5. The phase weights are nearly quadratic phase progressions, the foci of which lie at the interferometer center. The position of the foci are moved to provide frequency compensation. This varies the apparent value of D which is the distance between the transmit phase centers. The transmit distribution 31 at a nominal operation frequency F1, at which the desired phase center equals the physical phase center of the sub-array 12, varies from a transmit distribution 32 of the antenna at a different frequency F2. Changing D as the transmit frequency is changed forces the beamset to the desired positions in angle space and provides a desired frequency compensation. This compensation thus attained complements the receive compensation achieved by interpolation discussed above. Thus, both transmit and receive beams are stabilized to the desired positions and space as frequency is changed.

A transmit phase weight distribution shown in FIG. 6A illustrates the differences without compensation, indicated at 34, and with the frequency compensation of the present invention, indicated at 36. The transmit phase weight in aperture is plotted against the phase weight in radians. The distribution with compensation 36 increases the phase weight in aperture dimensions away from the center.

Figure 6C:
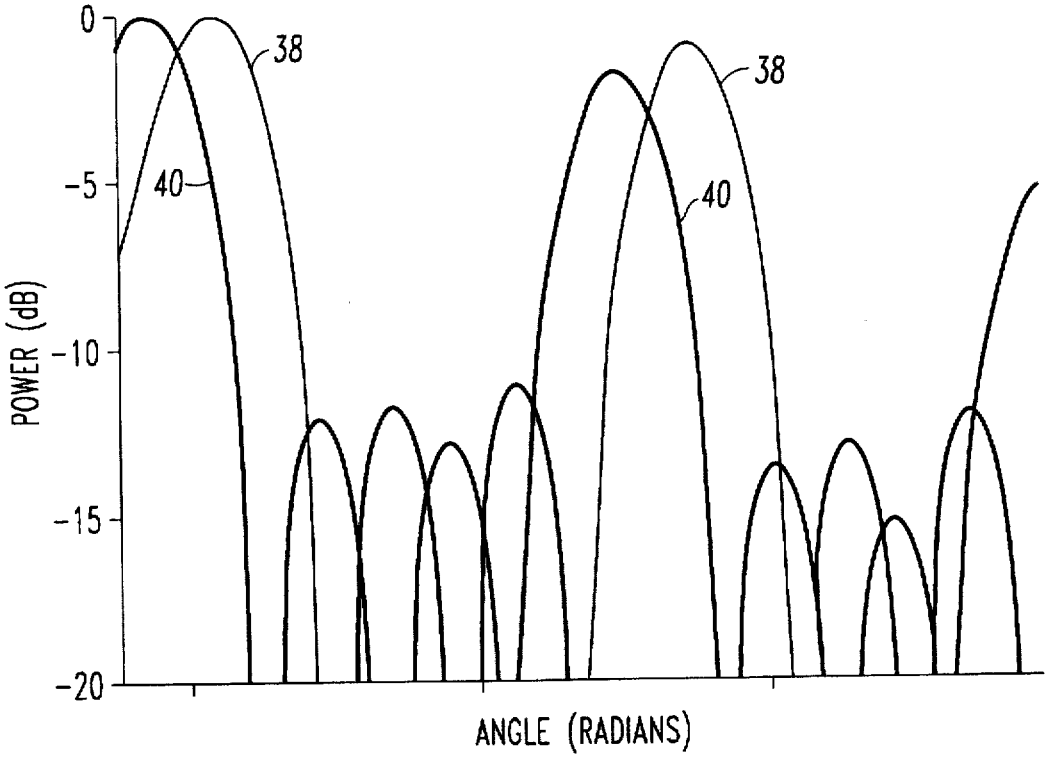
FIG. 6C shows the transmission beamset with and without frequency compensation of the present invention for the encircled portions in FIG. 6B.

The resulting transmit pattern, which is the FFT of the phase weight shown in FIG. 6A, is shown in FIGS. 6B and 6C. The array is operated in the microwave region. The circled portions in FIG. 6B are enlarged in FIG. 6C, in which the transmit beamset without frequency compensation is indicated at 38 and the transmit beamset of with frequency compensation of the present invention is indicated at 40. Again, the compensated beams 40 are pulled back toward the center.

Thus, the frequency compensation of the present invention allows both the transmit and receive beams to be stabilized to the desired positions in space as operation frequencies of the array change. The present invention is effective and practical.

The invention being thus described, it will be obvious that the same may be varied in many ways. Such variations are not to be regarded as a departure from the spirit and scope of the invention, and such modifications as would be obvious to one skilled in the art are intended to be included within the scope of the following claims.

What is claimed is:

1. A frequency compensator for a multi-beam antenna array arranged in sub-arrays and operational at multiple frequencies comprising:

a plurality of multi-frequency sub-arrays, each sub-array including a plurality of antenna elements;

input/output means for coupling signals to and from said sub-arrays;

an interpolator connected to said input/output means which positions the sub-array spacing of each said sub-array at a desired apparent location for a particular operating frequency during a receive mode; and a phase weight adjuster coupled to said input/output means for moving apparent phase centers of a beamset for a particular operating frequency during a transmit mode, whereby beam spacing of all beamsets remain virtually constant for a plurality of operational frequencies during said transmit and receive modes.

2. A frequency compensator as recited in claim 1 wherein said interpolator comprises a linear interpolator for generating compensated signal data S(J+e) for each sub-array where the signal data from each sub-array (J) is S(J) and (e) is the desired fraction of a sub-array spacing that a sub-array (J) is moved and wherein S(J+e) is determined from the expression, $$S(J+e)=S(J)+e/2^{*}\ (S(J+1)-S(J-1))$$

where (J+1) and (J−1) comprise signal data for the sub-arrays on opposite sides of the sub-array (J).

3. A frequency compensator as recited in claim 2 and additionally including a beamformer connected to and receiving signal data from said interpolator.

4. A frequency compensator as recited in claim 3 and wherein said interpolator comprises a controllable attenuator coupled to each sub-array, and a respective signal coupler for each controllable attenuator, each said coupler including an output port and a plurality of input ports, and wherein the output port of each coupler is coupled to the beamformer, one input port of all said couplers is coupled to its respective controllable attenuator, one other input port is coupled to an immediate adjacent controllable attenuator for a coupler at an end of the array, and wherein two other input ports are respectively coupled to immediate adjacent controllable attenuators on either side of said respective controllable attenuator for couplers intermediate the ends of the array, whereby scaled signal samples from a sub-array on either side of a sub-array are added/subtracted to the signal sample of said sub-array, thereby causing an apparent change in position of said sub-array as a function of operational frequency.

5. A frequency compensator as recited in claim 1 wherein said phase weights focus transmit energy so that far field signals resemble signals of a discrete interferometer.

6. A frequency compensator as recited in claim 5 wherein said phase weights comprise substantially quadratic phase progressions having a foci which lie at an interferometric center so as to provide frequency compensation by moving said foci as a function of operational frequency.

7. A method for compensating for a change in frequency in a multi-frequency array having multiple elements arranged in sub-arrays, comprising the steps of:

varying the operational frequency of the array; and adjusting an apparent position of the sub-arrays to a desired position in accordance with said operational frequency, wherein a spacing of a beamset output from the sub-arrays is constant;

wherein said adjusting step during a receive mode includes interpolating a desired position of each of the sub-arrays in accordance with a received signal impinging on a sub-array and scaled samples of received signals impinging on a sub-array immediately adjacent to said sub-array, said scaled samples being added to or subtracted from said received signal; and wherein said adjusting step during a transmit mode includes altering phase weighting of the sub-arrays in accordance with the operational frequency.

8. A method as recited in claim 7 wherein said step of interpolating comprises generating compensated signal data S(J+e) for each sub-array where the signal data from each sub-array (J) is S(J) and (e) is the desired fraction of a sub-array spacing that a sub-array (J) is moved and wherein S(J+e) is determined from the expression, $$S(J+e)=S(J)+e/2,\ (S(J+1)-S(J-1))$$

where (J+1) and (J−1) comprise sub-arrays immediately adjacent the sub-array (J).

* * * * *